US005154641A

United States Patent [19]

McLaughlin

[11] Patent Number: 5,154,641

[45] Date of Patent: Oct. 13, 1992

[54] ADAPTER TO ENERGIZE A LIGHT RAIL

[75] Inventor: Donald D. McLaughlin, Austin, Tex.

[73] Assignee: Lucifer Lighting Company, San Antonio, Tex.

[21] Appl. No.: 693,700

[22] Filed: Apr. 30, 1991

[51] Int. Cl.[5] ..... H01R 13/68

[52] U.S. Cl. ..... 439/621; 439/115

[58] Field of Search ..... 439/115, 621, 622, 78; 362/219

[56] References Cited

U.S. PATENT DOCUMENTS

| | | | |
|---|---|---|---|
| Re. 14,950 | 9/1920 | Hessel . | |
| Re. 30,367 | 8/1980 | Belokin | 339/50 R |
| 2,250,513 | 7/1941 | Von Gehr | 173/334.1 |
| 2,651,024 | 9/1953 | Miller | 339/55 |
| 2,977,566 | 3/1961 | Neumann et al. | 339/119 |
| 3,060,293 | 10/1962 | Lapidus | 200/133 |
| 3,229,066 | 1/1966 | Rowe | 200/133 |
| 3,582,866 | 6/1971 | Johnson et al. | 339/50 |
| 3,676,830 | 7/1972 | Donato | 339/21 R |
| 3,894,781 | 7/1975 | Donato | 339/22 B |
| 4,001,571 | 1/1977 | Martin | 240/9 R |
| 4,082,395 | 4/1978 | Donato et al. | 339/21 R |
| 4,096,349 | 6/1978 | Donato | 174/68 R |
| 4,113,340 | 9/1978 | Rapata | 339/113 R |
| 4,181,388 | 1/1980 | Donato | 339/21 R |
| 4,218,106 | 8/1980 | Belokin | 339/32 R |
| 4,272,689 | 6/1981 | Crosby et al. | 307/147 |
| 4,367,417 | 1/1983 | Casasanta | 307/147 |
| 4,399,371 | 8/1983 | Ziff et al. | 307/147 |
| 4,482,944 | 11/1984 | Roossine et al. | 362/418 |
| 4,500,796 | 2/1985 | Quin | 307/147 |
| 4,511,200 | 4/1985 | Belokin | 339/50 R |
| 4,575,704 | 3/1986 | Piezold | 439/622 X |
| 4,684,914 | 8/1987 | Wu | 337/198 |
| 4,688,869 | 8/1987 | Kelly | 439/209 |
| 4,745,537 | 5/1988 | Cheung | 362/219 X |
| 4,758,184 | 7/1988 | Call | 439/622 |
| 4,775,802 | 10/1988 | Dods | 307/147 |
| 4,834,664 | 5/1989 | Lin | 439/145 |
| 4,842,534 | 6/1989 | Mobley et al. | 439/214 |
| 4,874,320 | 10/1989 | Freed et al. | 439/115 |
| 4,904,976 | 2/1990 | Liaq | 337/197 |
| 4,978,319 | 12/1990 | Freed | 439/638 |
| 5,027,262 | 5/1991 | Freed | 439/115 |
| 5,046,956 | 9/1991 | Takano | 439/78 |

*Primary Examiner*—Eugene F. Desmond
*Attorney, Agent, or Firm*—Gunn, Lee & Miller

[57] ABSTRACT

A lighting system comprising a light rail (40) and an adapter (10) for energizing the light rail (40). The light rail (40) is comprised of a substantially flat, thermoplastic, elongated track (46) enclosing two conductive strips (45) and (47) from which multiple pairs of oppositely polarized spades (41), (42), (43) and (44) project. Each pair of the multiple paired spades receives an illuminating lamp (not shown), except a pair energized by the adapter. The adapter (10) has a body (12) with a pair of spade receiving slots (22) and (24) dimensioned to receive therein the paired spades (42) and (43) of the rail to energize the same. A removable fuse (37) extends longitudinally across the body (12) of the adapter (10) to protect against circuit overload.

6 Claims, 3 Drawing Sheets

ADAPTER TO ENERGIZE A LIGHT RAIL

Field of the Invention

The present invention relates to light rail systems, more particularly to an adapter designed to energize a lighting rail. The adapter is comprised of a body with a pair of receiving means therein, to receive conductors projecting from the of the light strip.

BACKGROUND

Lighting fixtures are available in a wide variety of categories, including desk or table lamps, ceiling fixtures, fluorescent or neon tubing and specialty lamps such as track lighting or spotlights. The present invention is directed to an adapter to energize a lighting system which provides electrical power to a continuous light rail strip of indefinite length. Light strips for light rail systems achieve the semblance of continuous lighting by providing multiple paired sockets, each for receiving an illuminating lamp.

Generally there are two types of light rail assemblies. The first type contains those with paired contacts depending from a flat or winged rail or strip from which lamp fixtures are fixedly attached. This type will be referred to as the spade type of light rail, although the contacts may have a variety of configurations. The second type consists of a track including downwardly depending open slots providing access to the interior of the track. This type will be called the track type of light rail. Supported within the interior of the track or channel are two or more electrical conductors in suitably insulated carriers.

In the space type, an illuminating fixture is fixedly attached in a position determined by the location of the paired spades, in the track type the illuminating fixture may be mounted into the vertical access slot of the track at any point along the length thereof. Both types generally are available in precut lengths, such as 4-foot, 8-foot, or 12-foot sections with power delivered to one end thereof. Electrical distribution assemblies of both types are considered convenient for providing specialized lighting or supplementing the principal lighting in the interior of a dwelling.

The invention of the present application discloses an adapter for use with the spade type of light rail assemblies and, more specifically, to an adapter distributing electrical energy to one or more sections.

Light rails of the spade type have been devised which incorporate incandescent lamps. Two such light rails are depicted in U.S. Pat. Nos. 4,148,221 and 4,521,838, both issued to Y. Agabekov, on Jun. 12, 1979, and Jun. 4, 1985 respectively. These devices consist essentially of a winged bar having two conductive strips set perpendicular to one another, on each wing of the rail. A series of conductor tabs extend perpendicular from the conductive strips and are appropriately paired to receive tubular lamps. The Agabekov strip is energized from tabs extending from the ends thereof.

U.S. Pat. No. 4,874,320 assigned to assignee of the present invention discloses a device for energizing a flat, spade type light strip similar to applicant's light strip. The device comprises a tabular body with a pair of spade receiving slots laying in the same plane. The device is designed to receive a pair of spades extending longitudinally from an end of an insulating, thermoplastic envelope, and lying in the same plane thereof.

U.S. Pat. No. 4,096,349 discloses lighting strips with flexible spanning connectors on the ends thereof so that a first rigid strip could be flexibly and electrically connected to a second rigid strip yet which allow the strips to maintain a non-parallel alignment.

U.S. Pat. No. 2,977,566 discloses a light rail with a conventional, flexible electrical cord coming out one end of a fixture holding track.

U.S. Pat. No. 3,894,781 discloses a connector plug for power distribution in a light rail of the track type having an open channel housing insulated conductive conduit. The plug includes a pair of wings or flanges for rotation into mechanically locked engagement with portions of the track and a pair of contact portions rotatable into electrically coupled relation with the conduits of the track.

U.S. Pat. No. 3,676,830 discloses an elongated electrical distribution assembly int he form of a light rail, channel or track and connectors for sections thereof. This is another track type with a continuously open downward depending slot for the electrical and mechanical attachment of fixtures beneath the track.

U.S. Pat. No. 4,082,395 discloses a module consisting of a clamp which retains the wires energizing the lighting strip at a fixed location at one end thereof.

Lucifer Lighting product "PSC" and "WSC" shows plastic strip connectors and wire strip connectors designed to attach two strips in tandem.

The prior art discloses a variety of adapters or connectors that provide for energy distribution to the light rail system. None, however, provide for easily electrifying a spade type, lighting strip of indefinite length. That is, strips are generally manufactured in predetermined lengths, such as 2-foot, 4-foot, 6-foot, etc. The strips are energized at one end thereof and, if longer lengths are desired, connected end to end with additional strips until the desired length is reached. Applicant recognized the need for continuous light strips which may be custom cut to any length, and an adapter to energize the same without modification of the end pieces. To this end, applicant has provided a light strip with an adapter that allows the light strip to be delivered to the work place in bulk rolls rather than discrete lengths.

SUMMARY OF THE INVENTION

It is a purpose of the present invention to provide an adapter to energize a light rail by utilizing pre-existing conductive means of the light rail system.

It is a further purpose of the present invention to provide an adapter to energize a light rail system without the necessity of modifying the ends of the lighting strip.

It is a further purpose of the present invention to provide for a light rail system with a fuse containing adapter to monitor and distribute energy such that it allows for light strips of indefinite length, restricted only by the current carrying capacity of the strip.

It is a further object of the present invention to provide for a light rail system with an adapter capable of receiving paired spades, which paired spades are capable of receiving illuminating fixtures, and for energizing the same.

It is a further object of the present invention to provide for an adapter connection to receive conductive spades of a light rail system and to energize the same.

It is a further purpose of the present invention to provide for an adapter for energizing and distributing energy to a light rail system which contains a fuse receiving socket integral therewith, to control energy capacity.

It is a further object of the present invention to provide an adapter for supplying and distributing energy to a light rail system comprised of two or more light rail lengths, which adapter does not require modifications of the ends of such lengths.

It is a further object of the present invention to provide for a lighting system comprised of a substantially flat envelope containing a pair of conducting strips with paris of conducting spades projecting therefrom and an adapter for energizing the same.

DETAILED DESCRIPTION OF THE PREFERRED EMBODIMENTS

Figure 1:
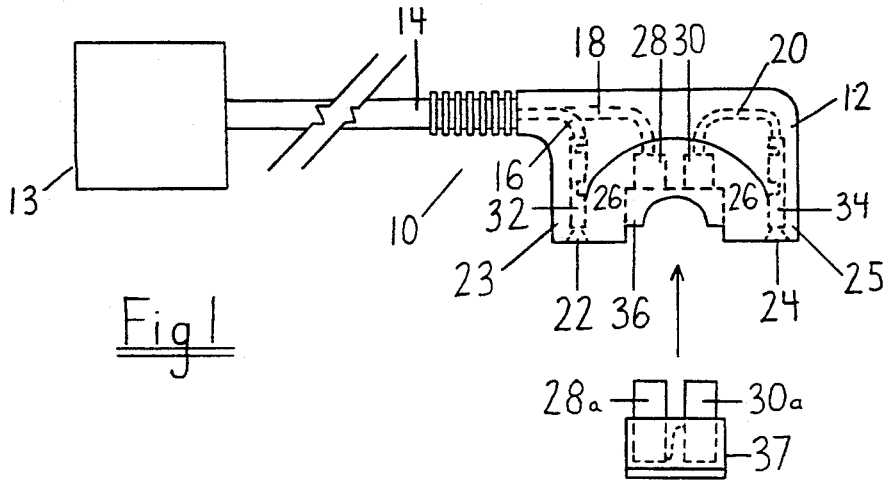
FIG. 1 is an elevational view of the adapter with the fuse extended away therefrom.
Figure 3:
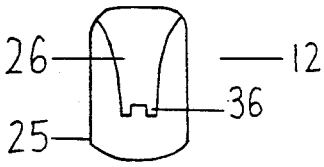
FIG. 3 is a cross-sectional view through section A—A.
Figure 2:
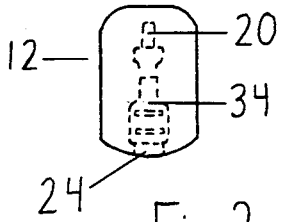
FIG. 2 is an end view of the adapter.

FIGS. 1, 2 and 3 show three views of the preferred embodiment of an adapter (10). As can be appreciated form the views, adapter (10) is comprised of three portions: a body (12), a transformer (13), and an insulated electrical cord or wire (14). Contained within wire (14) is a first conductor (16) and a second conductor (18). These extend into body (12) which also contains therein a third conductor (20).

Body (12) contains a first spade slot (22) at a proximal end (23) thereof. Body (12) contains a second spade slot (24) at a distal end (25) thereof. Between proximal end (23) and distal end (25) lies a central portion (26). Central portion (26) contains two slots (28) and (30). Spade slots (22) and (24) contain integral therewith a first connector means (32) and a second connector means (34). Connector means (32) and (34) lie deposed adjacent to the spade slots and are connected to, respectively, first conductor (16) and either of second conductor (18) (not shown) or third conductor (20) respectively. An insert portion (36) is dimensioned to receive a fuse (37).

As can be seen in FIG. 1, fuse (37) contains fuse spades (28*a*) and (30*a*). Central portion (26) containing slots (28) and (30) and insert portion (36) have been dimensioned to receive insertable fuse (37) and thereby provide connection between second connector means (34) and second conductor (18).

Figure 5:
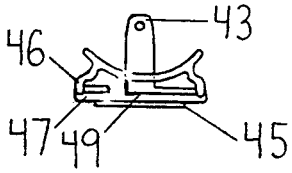
FIG. 5 is a cross-sectional view of a light rail.
Figure 4:
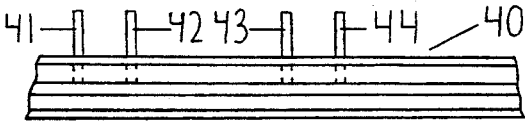
FIG. 4 is a side view of a light rail.
Figure 6:
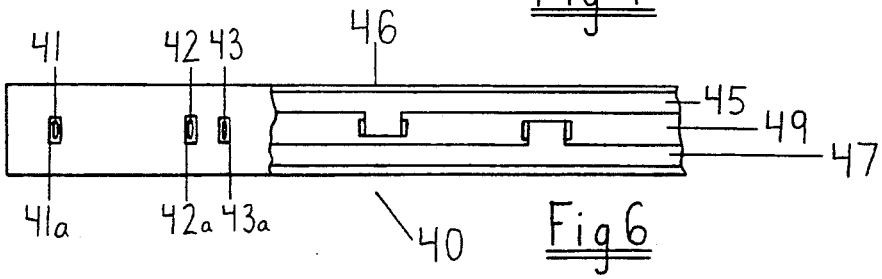
FIG. 6 is a partially cutaway platform top view of a light rail.

FIGS. 4, 5 and 6 illustrate a light strip (40), containing contact spades (41), (42), (43) and (44). As can be appreciated from FIGS. 4, 5 and 6, light strip (40) is comprised of a substantially flat, thermoplastic envelope (46) which contains two flat, spaced apart, parallel conductive strips (34) and (47). The conductive strips each have a plurality of lateral extensions projecting alternately into a space (49) between the strips. Contact spades (41), (42), (43), etc. project perpendicular form the lateral extensions as more clearly seen in FIG. 6, through slots (41*a*), (42*a*), (43*a*), etc. The construction of lighting strips (40) are more specifically set forth in U.S. Pat. No. 4,874,320.

Returning now to FIGS. 1, 2 and 3, it can be appreciated that the shape of body (12) is generally tabular with a longitudinal axis parallel to the longitudinal axis of light strip (40) when body (12) is inserted onto conductive spades (42) and (43). Spade slots (22) and (24) are dimensioned to receive contact spades (42) and (43) to energize the same. Contact spades (42) and (43) normally contain therebetween an illuminating lamp (not shown). However, when electrical energy is supplied to transformer (13) and body (12) is inserted onto contact spades (42) and (43), lighting strip (40) with additional paired spades, containing illuminating lights, will be energized. Thus, adapter (10) provides a means of energizing and distributing energy to a lighting strip system which does nor require modifications to the ends of the lighting strips.

As can be appreciated from the drawings, and from the electrical nature of the adapter, dimensions may become important. The dimension "a" represents the length of wire (14) from the transformer (13) to the distal end of body (12). The recommended maximum length is preferably about 48.00 inches. This provides for a minimum of voltage drop between transformer (13) and body (12). Length of body (12) from proximal end to distal end is represented by the dimension "b" and is preferably about 2.00 inches. Spades slots (22) and (24) are dimensioned a sufficient distance apart to slidably receive spades (42) and (43). This dimension is given by dimension"c" and is preferably about 1.647 inches. The height of body (12) is preferably about 1.25 inches, thereby providing for sufficient height to encompass spades (42) and (43) as well as fuse (37). The thickness of body (12) is preferably about 0.78 inches and is denoted by dimension "e" in FIG. 2. This narrow profile ensures that it is sufficiently thick to encompass spades (42) and (43) and fuse (37), within insulating body (12), but is not too thick to extend beyond the boundaries of envelope (46). These dimensions provide for an aesthetically pleasing look, as well as being functional in the manner set out above. It is to be appreciated that the dimensions require a body which is not too long so a to interfere with adjacent spades, when attached lighting strip (40). Nor should body (12) overhand edges of envelope (46). Finally, body (12) may be slightly concave in central portion (26) thereof (as seen in FIG. 3) so as to give the consumer an easier grip when inserting or removing body (12) to lighting strip (40). Body (12) with proportions as generally set forth above will be referred to as a tabular, elongated body, as is more appreciated from views represented by FIGS. 1 and 2.

An additional preferred embodiment is similar to that as illustrated in FIGS. 1, 2 and 3, except that there is no fuse, or required structure therefor. That is, an additional preferred embodiment would contain body (12) with a solid central portion (without any of the fuse adapting apparatus) and with second conductor (18) attaching directly to second connector means (34). An additional preferred embodiment would include the fuse contained in embodiment illustrated in FIGS. 1, 2 and 3 at one end of insulated wire (14) and at a second end of the insulated wire (14), instead of the transformer (13), simply a fuse-less body of the type herein described immediately above. This alternate preferred embodiment, with two bodies at either end of the wire, one of which contains a fuse, and the other without a fuse, is used to transfer electrical energy from an energized strip to an adjacent, non-energized strip. This is especially useful when the second strip is at an angled relationship to the first. That is, the first energized strip would contain embodiments set forth in FIGS. 1, 2 and 3, with body (12) inserted on conductor spades (42) and (43) to energize the strip. At a second pair of conducting spades, the two bodied adapter would transfer electrical energy for the first strip to a second strip, and from a second strip to a third strip, etc. Of course, care must be taken not to exceed the rated amperage for the system. The fuse in the system may be a 5–25 amp fuse, depending on the requirements and limitations of the lighting system.

Figure 7:
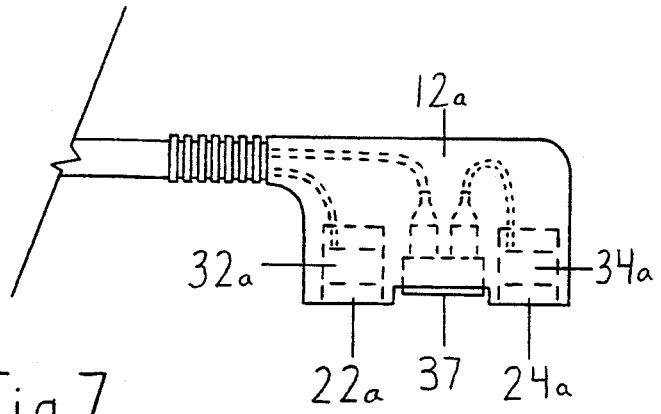
FIG. 7 is a side view of an alternate preferred embodiment.
Figure 8:
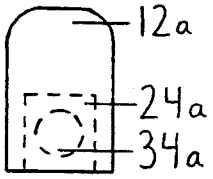
FIG. 8 is an end view of an alternate preferred embodiment.
Figure 9:
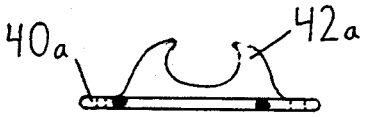
FIG. 9 is a side view of an alternate preferred embodiment into which the adapter fits.
Figure 10:
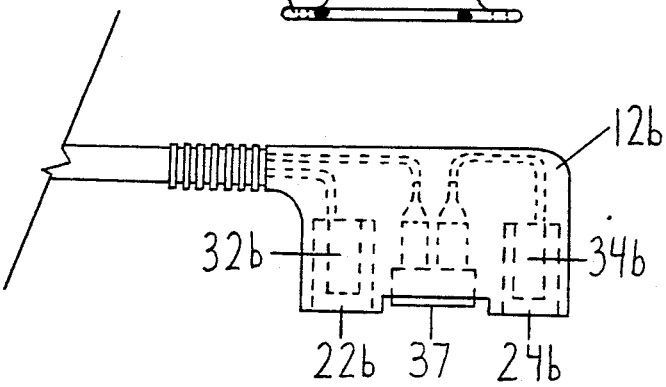
FIG. 10 is a side view of another alternate preferred embodiment.
Figure 12:
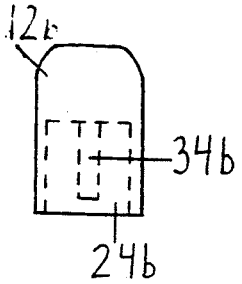
FIG. 12 is an end view of another alternate preferred embodiment.

Additional preferred embodiments are illustrated in FIGS. 7, 8, and 9 ("a"), in which contact spade (42*a*) is cup-shaped to cooperatively engage cylindrically shaped first and second connector means (32*a*) and (34*a*) respectively. Similarly, first spade slot (22*a*) and second spade slot (24*a*) are dimensioned to allow access within body (12*a*) of contact spade (42*a*).

Figure 11:
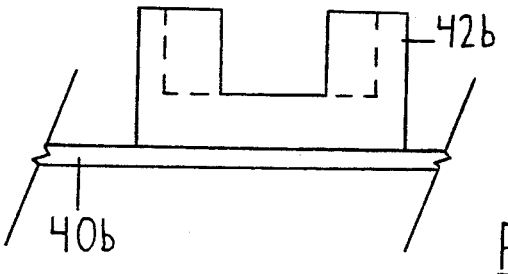
FIG. 11 is a side view of the strip on which the adapter fits.
Figure 13:
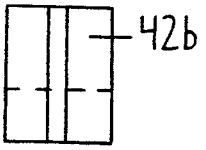
FIG. 13 is an end view of the adapter onto which the preferred embodiment illustrated in FIGS. 10 and 11 fits.

FIGS. 10, 11, 12 and 13 illustrate yet another preferred embodiment ("b"), which discloses first spade slot (22*b*) and second spade slot (24*b*) containing therein first connector means (33*b*) and second connector means (34*b*). This particular connector means configuration is designed to mate with a light strip configured as seen in FIG. 11 with contact spades (42*b*) slotted to receive tabular connector means (32*b*).

Figure 14:
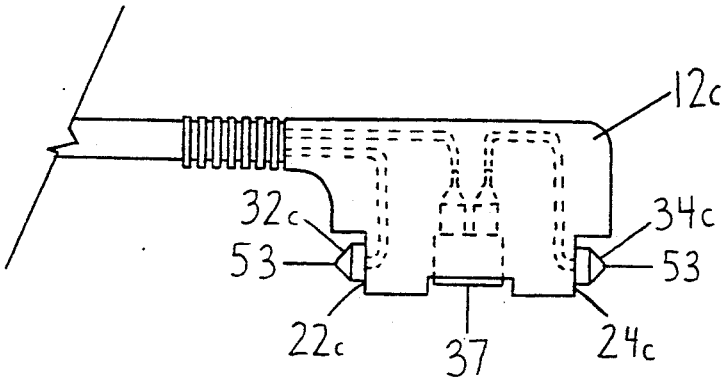
FIG. 14 is a side view of another alternate preferred embodiment of the adapter.
Figure 15:
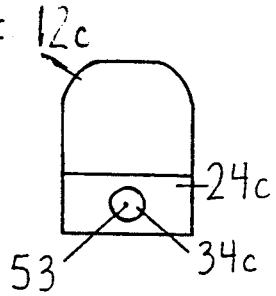
FIG. 15 is an end view of the embodiment illustrated in FIG. 14 and FIG. 16.
Figure 16:
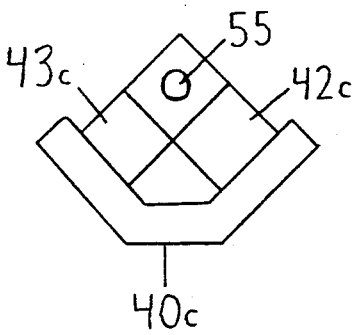
FIG. 16 is an end view of the lighting strip in which the embodiment illustrated in FIG. 14 fits.

FIGS. 14, 15 and 16 illustrate yet another preferred embodiment ("c") of the present invention. This preferred embodiment is designed to adapt to a light strip (40*c*) configured as seen in FIG. 16. The first spade slot (22*c*) and second spade slot (24*c*) are open. First connector means (32*c*) and second connector means (34*c*) are dimensioned as illustrated such that tips (53) fit into holes (55) of alternating contact spades (42*c*) and (43*c*), which contact spades project form non-aligned conductive strips but at the distal ends thereof are aligned along a longitudinal axis defined by holes (55).

Thus it can be seen, that applicant's invention may be adapted to light strips with a variety of contact spades. This includes tabular contact spades as illustrated in FIG. 4, cup-shaped contact spades in FIG. 9, slotted spades as illustrated in FIG. 11 and non-parallel contact spades as illustrated in FIG. 16. Regardless of the geometry of the lighting strip, applicant's invention is adapted to and dimensioned to energize contact spades that are designed t normally hold light fixtures. In addition, applicant's invention provides a fuse means between the light rail and the power source, to prevent the light rail from drawing current which exceeds its design limitations.

Terms such as "left," "right," "up," "down," "bottom" "top," "front," "back," "in," "out," and like are applicable to the embodiments shown and described in conjunction with the drawings. These terms are merely for purposes of description and do not necessarily apply to the position or manner in which the invention may be constructed for use.

Although the invention ash been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

I claim:

1. A system for providing light to an area by utilizing a multiple of elongated incandescent light fixtures, the light fixtures with electrical contacts at each end thereof, the system comprising:

a light strip with a surface thereon and having a pair of parallel conductive strips, the conductive strips each having a plurality of paired contact means projecting substantially perpendicular to the surface thereof, the distance between adjacent contact means dimensioned to accept the elongated incandescent light fixtures therebetween;

an insulated electrical cord containing a first electrical wire and a second electrical wire within said electrical cord, said electrical cord with a first end and a second end, said electrical cord capable of carrying electrical energy to said light strip for connecting at the first end to a source of electrical energy;

a tabular, elongated body attached to the second end of said electrical cord, said body with a pair of contact means receiving slots therein, the contact means receiving slots dimensioned to receive the contact means of said light strip;

a transformer for connecting to the first end of said electrical cord for supplying electrical energy to the same; and means to interconnect the two electrical wires of said insulated electrical cord with the paired contact means of said light strip;

wherein the contact means of said light strip are multiple, adjacent pairs of double-pronged, C-shaped conductors and interconnect means are cylindrical conductors dimensioned to fit within the prongs of the C-shaped conductors.

2. A system for providing light to an area by utilizing a multiple of elongated incandescent light fixtures, the light fixtures with electrical contacts at each end thereof, the system comprising:

a light strip with a surface thereon and having a pair of parallel conductive strips, the conductive strips each having a plurality of contact means projecting substantially perpendicular to the surface thereof, the distance between adjacent contact means dimensioned to accept the elongated incandescent light fixtures therebetween;

an insulated electrical cord containing a first electrical wire and a second electrical wire within said electrical cord, said electrical cord with a first end and a second end, said electrical cord capable of carrying electrical energy to said light strip for connecting at the first end to a source of electrical energy;

a tabular, elongated body attached to the second end of said electrical cord, said body with a pair of contact means receiving slots therein, the contact means receiving slots dimensioned to receive the contact means of said light strip;

means to interconnect the two electrical wires of said insulated electrical cord with the contact means of said light strip; and a transformer for connecting to the first end of said electrical cord for supplying electrical energy to the same;

wherein the insertion of said body onto contact means of said light strip is capable of energizing the light strip and providing light to the area to be illuminated; and wherein the interconnect means are tabular conductors aligned parallel with the longitudinal axis of said body and the contact means of said light strip are multiple, adjacent pairs of tabular conductor receiving means.

3. A system for providing light to an area by utilizing a multiple of elongated incandescent light fixtures, the light fixtures with electrical contacts at each end thereof, the system comprising:

a light strip with a surface thereon and having a pair of perpendicularly aligned conductive strips with parallel longitudinal axes, the conductive strips each having a plurality of contact means projecting substantially perpendicular to the surface thereof, the distance between adjacent contact means dimensioned to accept the elongated incandescent light fixtures therebetwen, wherein the contact means of said light strip is comprised of multiple paired spades projecting substantially perpendicular from said conductive strips such that the removed ends of said spades are aligned;

an insulated electrical cord containing a first electrical wire and a second electrical wire within said electrical cord, said electrical cord with a first end and a second end, said electrical cord capable of carrying electrical energy to said light strip for connecting at the first end to a source of electrical energy;

a transformer for providing electrical energy to the first end of said insulated electrical cord; and a tabular body attached to the second end of said electrical cord;

means to interconnect the electrical wires of said cord with the contact means of said strip, the interconnect means being paired cylindrical shaped rods truncated by a cone at one end thereof, each of said pair projecting partially from said tabular body at opposite ends thereof such that the cone-shaped ends of each of said rods engage one of the paired spades of the contact means of said light strip, the other ends of the interconnect means being connected to the electrical wires of said insulated electrical cord.

4. A system for providing light to an area, the system comprising:

a transformer;

a multiple of elongated, incandescent light fixtures with electrical contacts at either end thereof;

a first and a second substantially flat, insulation enclosed light strip having multiple contact spades projecting perpendicular from the insulation enclosure, the spades spaced apart sufficiently to engage the light fixtures for making electrical contact with the ends thereof;

a first adapter for energizing the first light strip, the adapter comprising a tabular body with spade receiving slots on a common face thereof, the spade receiving slots for engagement with the spades of said first light strip;

wire means attached to the body of said first adapter for bringing electricity from said transformer to the spades of said first light strip when adapter is engaged therewith;

a second adapter for energizing said second light strip, the sêcond adapter having a first and a second body, with conductive means conductively engaging the first body with the second body, each of said first and second body being tabular and having a pair of spade receiving slots on a common face thereof, the first body for engaging with a pair of spades from the first light strip and the second body for engaging a pair of spades form the second light strip, the first light strip being energized through said first adapter, thereby capable of energizing the second light strip.

5. The system as described in claim 4 wherein the transformer is a step-down type, stepping down voltage from a 120-volt primary source to a 24-volt secondary.

6. The system as described in claim 5 wherein the first adapter further comprises a fuse means, said fuse means integral with said body for accepting a fuse therein, and capable of interrupting an electrical circuit when the current overload condition exceeds the rating of said fuse.

* * * * *